US012498162B2

(12) United States Patent
Li et al.

(10) Patent No.: US 12,498,162 B2
(45) Date of Patent: Dec. 16, 2025

(54) REFRIGERATOR HAVING STORAGE SPACE FORMED ON DOOR BODY

(71) Applicants: QINGDAO HAIER REFRIGERATOR CO., LTD., Shandong (CN); HAIER SMART HOME CO., LTD., Shandong (CN)

(72) Inventors: Jiaming Li, Qingdao (CN); Hao Zhang, Qingdao (CN); Zhanpeng Cui, Qingdao (CN); Sen Mou, Qingdao (CN); Peng Lyu, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 308 days.

(21) Appl. No.: 18/245,328

(22) PCT Filed: Aug. 31, 2021

(86) PCT No.: PCT/CN2021/115633

§ 371 (c)(1),
(2) Date: Mar. 14, 2023

(87) PCT Pub. No.: WO2022/057613

PCT Pub. Date: Mar. 24, 2022

(65) Prior Publication Data

US 2023/0384017 A1 Nov. 30, 2023

(30) Foreign Application Priority Data

Sep. 15, 2020 (CN) ..... 202010969229.1

(51) Int. Cl.
*F25D 17/06* (2006.01)
*F25D 17/04* (2006.01)

(52) U.S. Cl.
CPC ..... *F25D 17/065* (2013.01); *F25D 17/042* (2013.01)

(58) Field of Classification Search
CPC .... F25D 17/065; F25D 17/045; F25D 23/025; F25D 23/04
See application file for complete search history.

(56) References Cited

U.S. PATENT DOCUMENTS

2012/0204581 A1* 8/2012 Kang ..... F25D 21/00 62/177
2020/0072528 A1* 3/2020 Buzzi ..... F25D 17/065
(Continued)

FOREIGN PATENT DOCUMENTS

CN 104075532 A 10/2014
CN 104807274 A 6/2015
(Continued)

OTHER PUBLICATIONS

International Search Report and Written Opinion for PCT/CN2021/115633 (ISA/CN) mailed Nov. 10, 2021 w/English Translation (9 pages).

(Continued)

*Primary Examiner* — Elizabeth J Martin
(74) *Attorney, Agent, or Firm* — troutman pepper locke; Tim Tingkang Xia, Esq.

(57) ABSTRACT

A refrigerator having a storage space formed on a door body. The refrigerator comprises: a refrigerator body in which at least a first storage space is defined, the first storage space having a forward opening; an inner-layer door pivotally provided on the front portion of the forward opening and comprising a storage container body defining a second storage space, the side of the storage container body facing the forward opening being provided with an air supply port used for introducing low-temperature air in the first storage space into the second storage space; a sterilization module (Continued)

provided at the air supply port and performing sterilization on passing air; an inner-layer door frame provided on the periphery of the storage container body; and an outer-layer door pivotally provided on the side of the inner-layer door frame away from the refrigerator body.

11 Claims, 7 Drawing Sheets

(56) References Cited

U.S. PATENT DOCUMENTS

| | | | | |
|---|---|---|---|---|
| 2020/0378678 | A1* | 12/2020 | Burke | F25D 23/04 |
| 2023/0033561 | A1* | 2/2023 | Im | F25D 23/028 |

FOREIGN PATENT DOCUMENTS

| | | | |
|---|---|---|---|
| CN | 105167110 | A | 12/2015 |
| CN | 212378330 | U | 1/2021 |
| EP | 3415846 | A1 | 12/2018 |
| EP | 3508804 | A1 | 7/2019 |
| JP | S63-142692 | U | 9/1988 |
| JP | 2000065459 | A | 3/2000 |
| JP | 2001255054 | A | 9/2001 |
| JP | 2002 115957 | A | 4/2002 |
| JP | 2017 026203 | A | 2/2017 |
| WO | WO 2004/059228 | A1 | 7/2004 |

OTHER PUBLICATIONS

EP Search Report for European Patent Application No. 21868440.5 dated Jan. 22, 2024 (4 pages).
1st Office Action for European Patent Application No. 21868440.5 dated Feb. 2, 2024 (6 pages).

* cited by examiner

REFRIGERATOR HAVING STORAGE SPACE FORMED ON DOOR BODY

CROSS-REFERENCE TO RELATED APPLICATIONS

The present application is a national phase entry of International Application No. PCT/CN2021/115633, filed Aug. 31, 2021, which claims priority to Chinese Application No. 202010969229.1, filed Sep. 15, 2020, which is incorporated herein by reference in its entirety.

FIELD OF THE INVENTION

The present invention relates to a refrigerator, and particularly to a refrigerator having a storage space formed on a door body.

BACKGROUND OF THE INVENTION

In an existing refrigerator, a storage space is generally formed by a refrigerator body, and is opened and closed through a door body. Such conventional spatial structure causes inflexibility of space division. Especially for a large-capacity refrigerator, the storage space cannot be fully used. In addition, it is likely to cause cold energy leakage when a user opens and closes the door body to take and put objects.

To fully use the space of the refrigerator, door-in-door structures have emerged in the prior art, that is, a door body includes an inner-layer door and an outer-layer door. The inner-layer door is configured to seal the space of a refrigerator body, and the inner-layer door itself includes a storage space as well. The outer-layer door is configured to seal the storage space on the inner-layer door. When needing to take or put objects on the inner-layer door, a user just needs to open the outer-layer door. This improves layout flexibility of the storage space.

However, in an existing door-in-door type refrigerator, the storage space on the inner-layer door is generally in direct communication with the storage space of the refrigerator body. After the outer-layer door is opened, it is still likely to cause cold energy leakage of the storage space of the refrigerator body. In addition, smell in the storage space of the inner-layer door and smell in the storage space of the refrigerator body are likely to be mixed with each other. Moreover, if there is spoiled food, bacteria will spread in the overall refrigerator.

BRIEF DESCRIPTION OF THE INVENTION

A purpose of the present invention is to provide a refrigerator in which a storage space of a door body and a storage space of a refrigerator body are independent of each other.

A further purpose of the present invention is to prevent spreading of bacteria between the storage space of the door body and the storage space of the refrigerator body.

In particular, the present invention provides a refrigerator having a storage space formed on a door body, and the refrigerator includes:

a refrigerator body, inside which at least a first storage space is defined, where the first storage space has a forward opening;

an inner-layer door, pivotally disposed at a front portion of the forward opening and including a storage container body, where the storage container body defines a second storage space, the second storage space is provided with an opening in one side away from the refrigerator body, the storage container body is provided with an air supply port in one side toward the forward opening, and low-temperature air in the first storage space is introduced into the second storage space via the air supply port to implement refrigeration inside the second storage space; a sterilization module, disposed at the air supply port and configured to sterilize the air passing through the air supply port;

an inner-layer door frame, disposed on the periphery of the storage container body; and an outer-layer door, pivotally disposed on one side of the inner-layer door frame away from the refrigerator body and configured to open and close the opening of the second storage space.

Optionally, the inner-layer door further includes an air supply assembly, where the air supply assembly is disposed at the air supply port and is configured to promote formation of a refrigerating airflow supplied from the first storage space to the second storage space.

Optionally, the storage container body includes:

a container main body, where the container main body is configured to constitute the second storage space, and one side of the container main body opposite to the refrigerator body protrudes toward the forward opening; and a housing, where the housing covers a protruding portion of the container main body; the housing and the top of the container main body form a mounting chamber; and the air supply port is formed in the top of the housing, and the air supply assembly is disposed inside the mounting chamber and opposite the air supply port.

Optionally, the air supply assembly includes: a fan bracket disposed at a top wall of the container main body, and an air supply fan mounted on the fan bracket, where the top wall of the container main body is provided with a communicating opening below the air supply fan.

Optionally, the sterilization module is mounted between the air supply fan and the communicating opening.

Optionally, the sterilization module is a negative-ion generator and includes a plurality of negative-ion emitters that are oppositely spaced apart below the air supply fan.

Optionally, the storage container body further includes a grating plate disposed at the communicating opening.

Optionally, the refrigerator body is further internally provided with an air supply duct, where the air supply duct extends from a refrigeration chamber of the refrigerator to a front portion of a top wall of the refrigerator body, and forms an air duct opening at a position opposite the air supply port, so that an airflow provided by the air supply duct is at least partially discharged into the air supply port.

Optionally, the storage container body further includes at least one dividing element configured to divide the second storage space into a plurality of storage areas.

Optionally, at least one of the storage areas is configured as a sealed drawer.

According to the refrigerator having a storage space formed on a door body in the present invention, the inner-layer door defines a second storage space by using the storage container body; the second storage space is provided with an opening in one side away from the refrigerator body, so that when the door body is closed, the second storage space on the door body is independent of the first storage space of the refrigerator body, avoiding cold energy leakage of the first storage space caused when the second storage space is opened, and also preventing smell in the first storage space from being mixed with smell in the second storage space during normal storage. In addition, the refrigerator provided by the present invention is additionally provided with the sterilization module at the air supply port, to sterilize refrigerating air introduced from the first storage space, thus preventing foods stored in the second storage space from being polluted by bacteria.

Further, the refrigerator having a storage space formed on a door body in the present invention is provided with the air supply assembly, where the air supply assembly is used to promote formation of a refrigerating airflow supplied from the first storage space to the second storage space. In addition, mounting positions and mounting structures for the air supply assembly and the sterilization module are optimized, thereby improving structural compactness and guaranteeing an available volume of the second storage space and reliability of refrigeration.

More further, according to the refrigerator having a storage space formed on a door body in the present invention, an internal structure of the second storage space is improved, such that a plurality of storage areas are formed in the second storage space, and a sealed drawer may be further formed, greatly expanding use flexibility of the second storage space.

Specific embodiments of the present invention are described below in detail with reference to the accompanying drawings, and persons skilled in the art can more clearly understand the above and other purposes, advantages and features of the present invention.

BRIEF DESCRIPTION OF THE DRAWINGS

Some specific embodiments of the present invention are described below in detail in an exemplary and unlimited way with reference to the accompanying drawings. The same or similar components or parts are indicated by the same reference numerals in the drawings. Persons skilled in the art should understand that these drawings are not necessarily drawn to scale. In the drawings.

DETAILED DESCRIPTION

In the descriptions of the present invention, it should be understood that the orientations or positional relationships indicated by the terms "up", "down", "front", "rear", "top", "bottom" and the like are based on the orientations or positional relationships shown in the accompanying drawings. Such terms are intended merely for the ease and brevity of description of the present invention without indicating or implying that the apparatuses or components mentioned must have specified orientations or must be constructed and manipulated in the specified orientations, and therefore shall not be construed as any limitation on the present invention. That is, if the embodiments of the present invention involve orientation indication (such as up, down, front, rear, top, bottom), the orientation indication is merely for explaining a relative positional relationship between components in a certain posture (for example, as shown in the accompanying drawings, or as a normal use state of the refrigerator).

Figure 1:
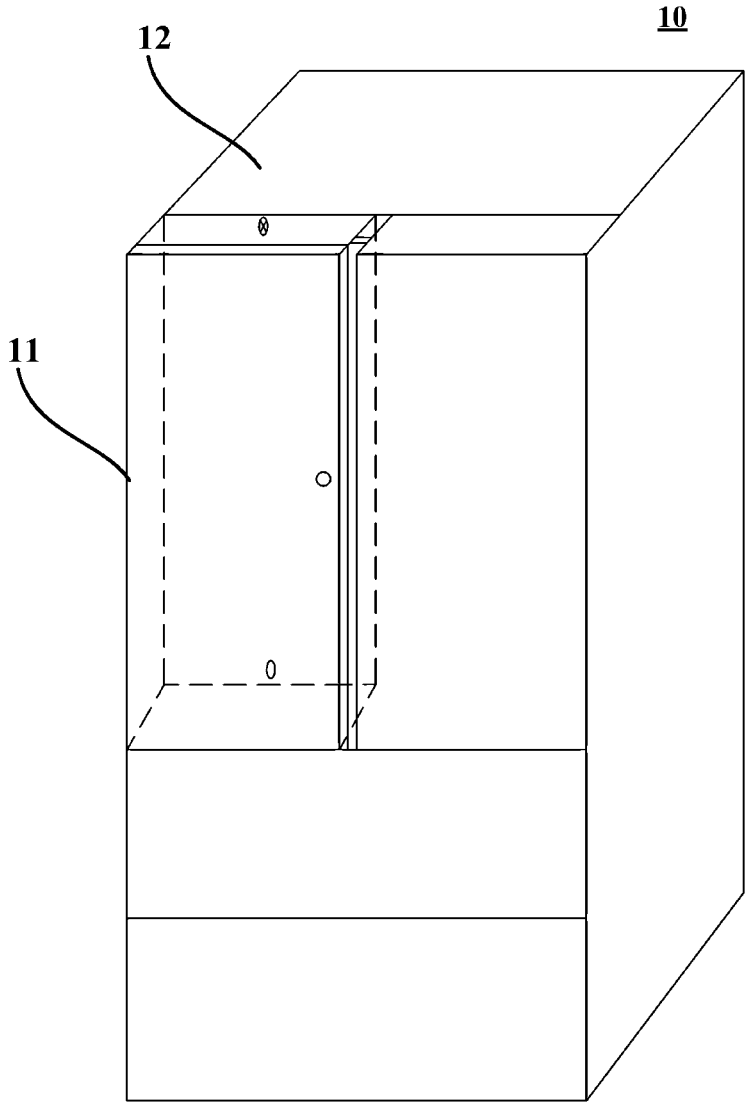
FIG. 1 is a schematic perspective view of a refrigerator having a storage space formed on a door body according to an embodiment of the present invention.

FIG. 1 is a schematic perspective view of a refrigerator 10 having a storage space formed on a door body 11 according to an embodiment of the present invention. The refrigerator 10 having a storage space formed on a door body 11 may generally include a refrigerator body 12 and the door body 11.

At least a first storage space (shielded by the door body 11 and unshown in the figure) is defined in the refrigerator body 12, where the first storage space has a forward opening. Generally, at least one storage space with an open front side is defined in the refrigerator body 12. Usually, a plurality of storage spaces are defined in the refrigerator body 12, where the storage spaces may be classified into a refrigeration chamber, a freezing chamber, a variable-temperature chamber and the like according to refrigeration temperatures and functions. Specific quantity and function of the storage space may be configured according to predetermined requirements. The first storage space may be one or more of a plurality of storage spaces defined by the refrigerator body 12.

The door body 11 is disposed on a front side of the refrigerator body 12 to open and close a storage chamber. For example, the door body 11 may be disposed on one side of a front portion of the refrigerator body 12 by means of hinging, to pivotally open and close the refrigerator body 12. The door body 11 may be configured according to layout of the refrigerator body 12. A layout structure of the refrigerator body 12 may be configured according to functions and requirements of the refrigerator, for example, the refrigerator body 12 may be configured as a side-by-side door type, a T type (cross door), a French type (four-door, or multi-door), or other types.

Figure 2:
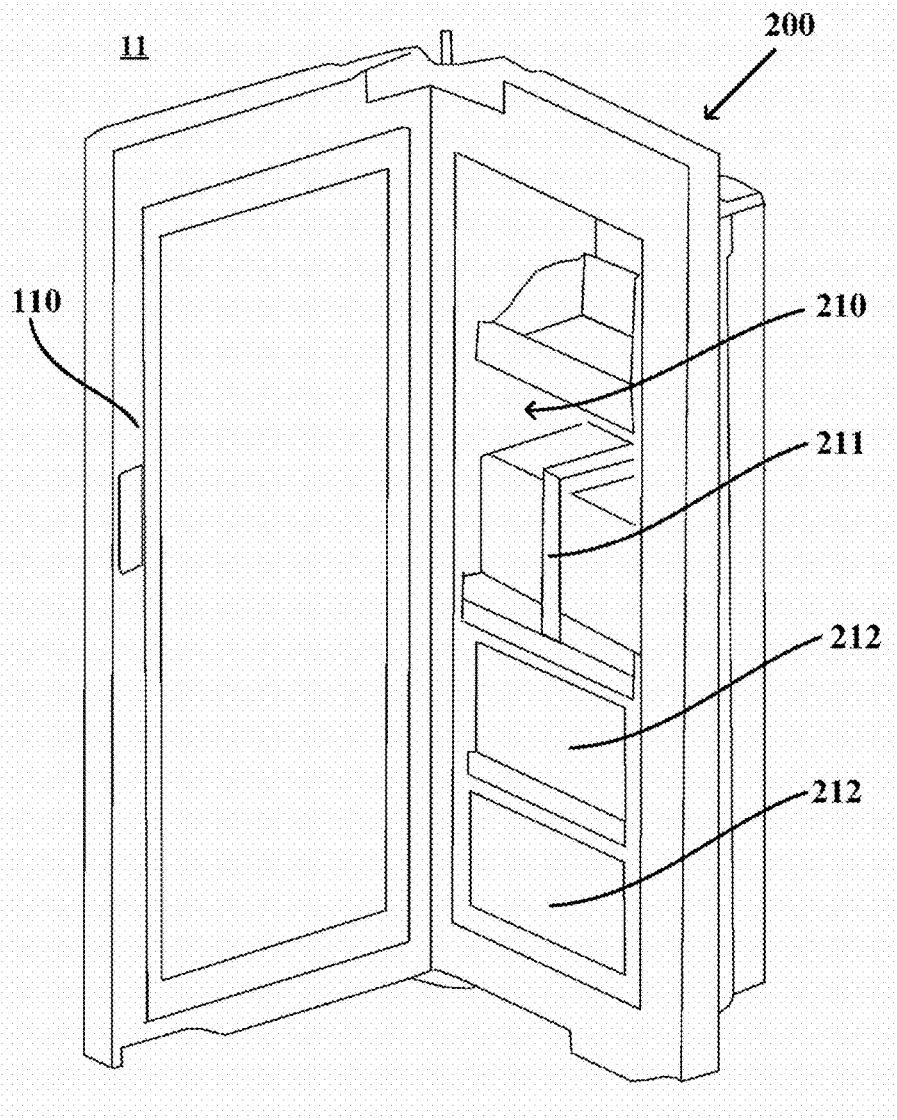
FIG. 2 is a schematic diagram from one perspective of a door body in a refrigerator having a storage space formed on the door body according to an embodiment of the present invention.
Figure 3:
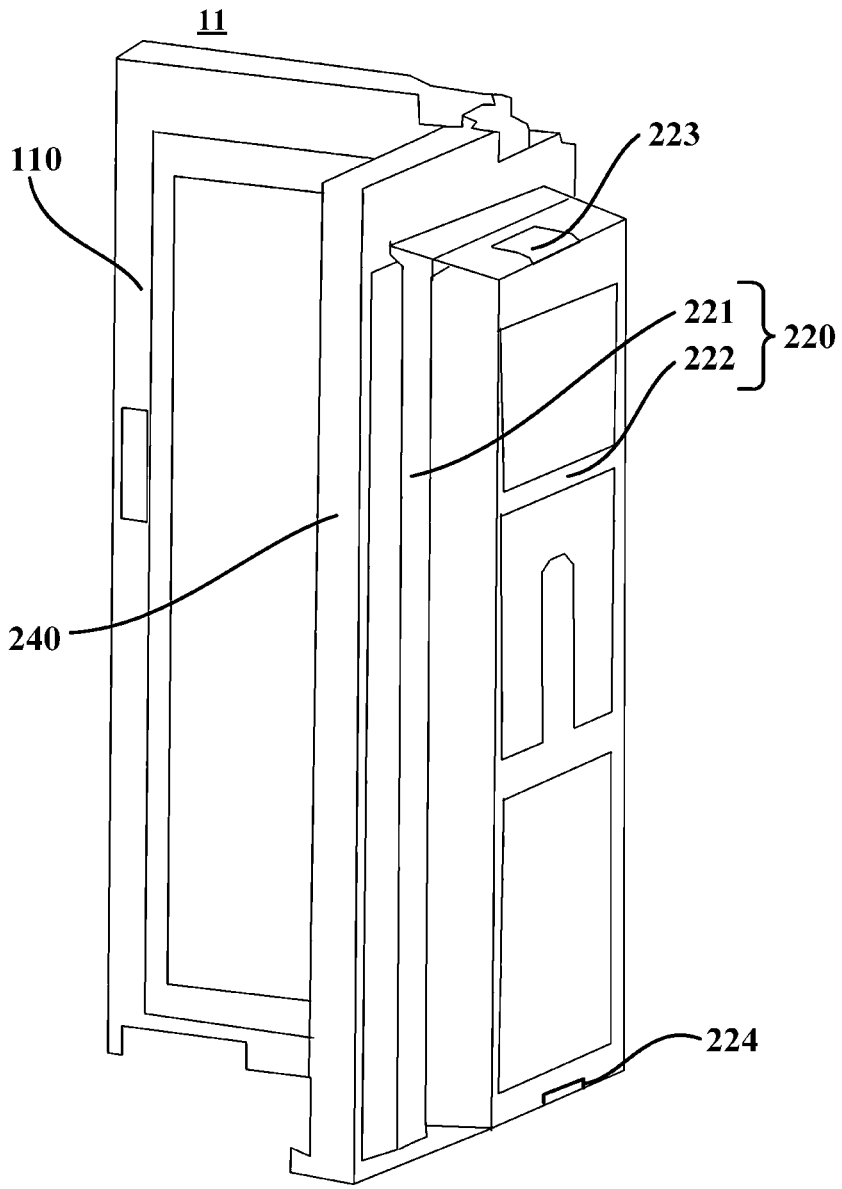
FIG. 3 is a schematic diagram from another perspective of a door body in a refrigerator having a storage space formed on the door body according to an embodiment of the present invention.

In the refrigerator 10 having a storage space formed on the door body 11 in this embodiment, the first storage space defined by the refrigerator body 12 has a forward opening, and is sealed by a double-layer door (or referred to as a door-in-door). FIG. 2 is a schematic diagram from one perspective of a door body 11 in the refrigerator 10 having a storage space formed on the door body 11 according to an embodiment of the present invention. FIG. 3 is a schematic diagram from another perspective of a door body 11 in the refrigerator 10 having a storage space formed on the door body 11 according to an embodiment of the present invention. FIG. 2 and FIG. 3 respectively show a front side structure and a rear side structure of the door body 11 when an outer-layer door 110 is open.

The door body 11 may include an inner-layer door 200 and an outer-layer door 110. The inner-layer door 200 may be pivotally disposed at a front portion of the forward opening, and a second storage space 210 may be defined in the inner-layer door 200. The outer-layer door 110 may be pivotally disposed on one side of the inner-layer door 200 away from the refrigerator body 12, and is configured to open and close the opening of the second storage space 210.

When the outer-layer door 110 is separately opened, the second storage space 210 may be exposed. In addition, the outer-layer door 110 and the inner-layer door 200 may be opened simultaneously to expose the first storage space defined by the refrigerator body 12. Since hinges and rotating structures of double-layer doors are well known to persons skilled in the art, they are not described in detail again in this embodiment.

In the refrigerator 10 in this embodiment, the second storage space 210 and the first storage space are independent of each other. When the outer-layer door 110 is separately opened, cold energy leakage of the first storage space can be avoided. Smell in the first storage space and smell in the second storage space can also be prevented from being mixed during normal storage.

Figure 4:
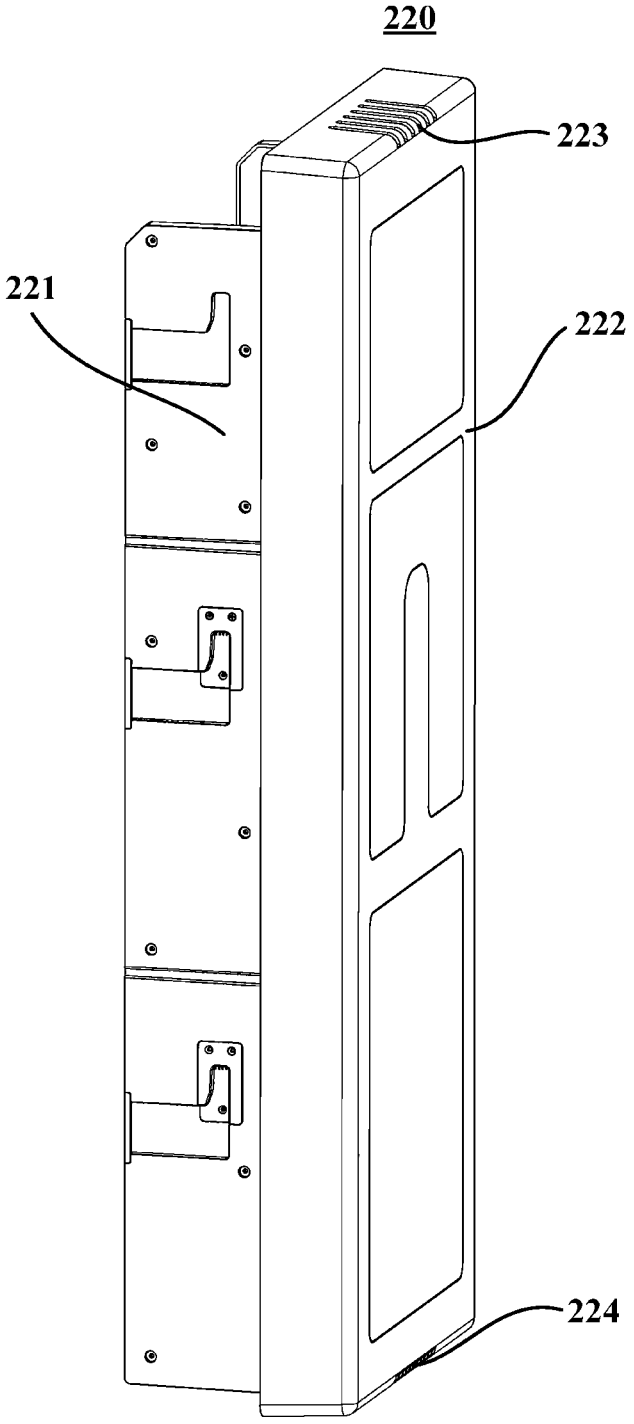
FIG. 4 is a schematic diagram of an inner-layer door in a refrigerator according to an embodiment of the present invention.
Figure 5:
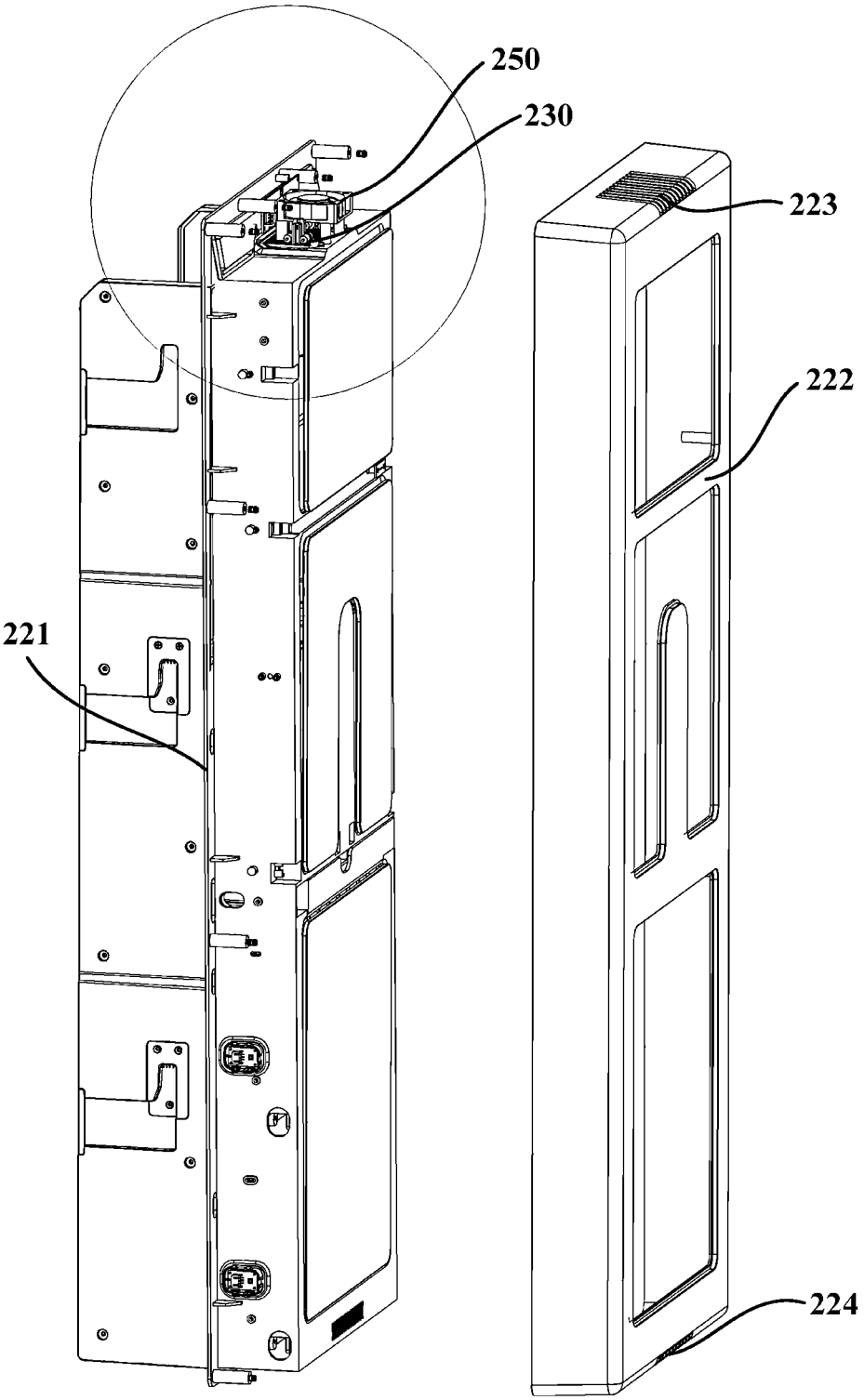
FIG. 5 is a schematic exploded view of an inner-layer door in a refrigerator according to an embodiment of the present invention.
Figure 6:
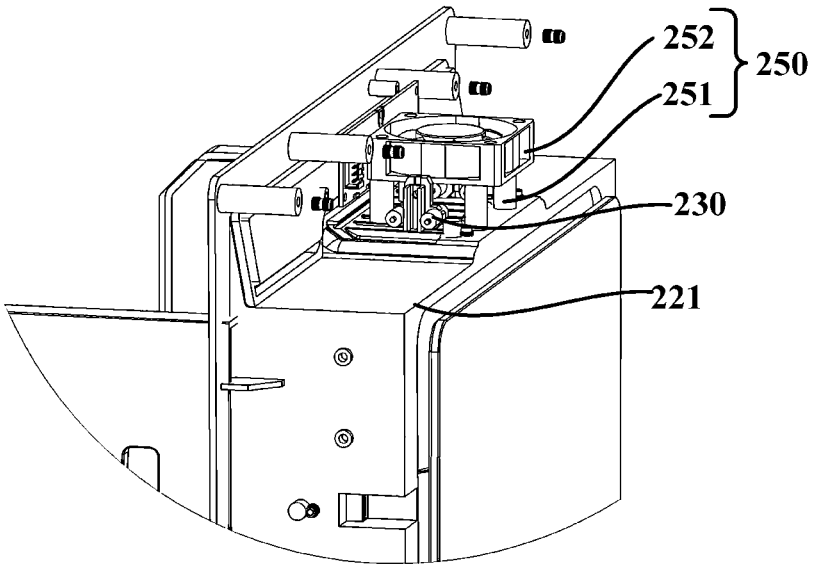
FIG. 6 is a schematic locally enlarged view of a top of a storage container body in the inner-layer door shown in FIG. 5.

FIG. 4 is a schematic diagram of an inner-layer door 200 in a refrigerator 10 according to an embodiment of the present invention. FIG. 5 is a schematic exploded view of components of an inner-layer door 200 in a refrigerator 10 according to an embodiment of the present invention. FIG. 6 is a schematic locally enlarged view of a top of a storage container body 220 in the inner-layer door 200 shown in FIG. 5. In FIGS. 4, 5 and 6, an inner-layer door frame 240 is hidden to show an internal structure of the inner-layer door 200.

The inner-layer door 200 may include a storage container body 220, a sterilization module 230 and an inner-layer door frame 240. The storage container body 220 defines the second storage space 210; the second storage space 210 is provided with an opening in one side away from the refrigerator body 12; the storage container body 220 is provided with an air supply port 223 in one side toward the forward opening; and low-temperature air in the first storage space is introduced into the second storage space 210 via the air supply port 223 so as to implement refrigeration inside the second storage space 210. The sterilization module 230 is disposed at the air supply port 223 and is configured to sterilize the air passing through the air supply port 223. The inner-layer door frame 240 is disposed on the periphery of the storage container body 220, and sealing structures between the inner-layer door frame and the outer-layer door 110 and between the inner-layer door frame and the refrigerator body 12 are disposed at two sides of the inner-layer door frame 240, respectively. In addition, a hinge structure of the door body 11 is also disposed on one side of the inner-layer door frame.

In comparison with a double-door refrigerator in the prior art, in which a rear side of the storage space of the inner-layer door 200 is in direct communication with the refrigerator body 12, the scheme of this embodiment is characterized in that the second storage space 210 obtains refrigerating airflow through only the air supply port 223 provided in the storage container body 220, thus preventing direct communication between the second storage space 210 and the first storage space. In addition, the sterilization module 230 additionally arranged at the air supply port 223 can be used to sterilize refrigerating air introduced from the first storage space, thus preventing foods stored in the second storage space from being polluted by bacteria.

The storage container body 220 may further include a container main body 221 and a housing 222. The container main body 221 is configured to constitute the second storage space 210, one side of the container main body 221 opposite to the refrigerator body 12 protrudes toward the forward opening, and the housing 222 covers a protruding portion of the container main body 221. To increase a volume of the second storage space 210, the container main body 221 protrudes toward the refrigerator body 12. As a rear wall of the storage container body 220, the housing 222 separates the first storage space and the second storage space 210.

The housing 222 is at least partially made of a material with good thermal conductivity, such as metal, so that cooling transfer from the first storage space to the second storage space 210 is facilitated.

To further meet a refrigeration requirement of the second storage space 210, the inner-layer door 200 further includes an air supply assembly 250. The air supply assembly 250 is disposed at the air supply port 223, and is configured to promote formation of a refrigerating airflow supplied from the first storage space to the second storage space 210.

The housing 222 and the top of the container main body 221 form a mounting chamber; in addition, the air supply port 223 is formed in the top of the housing 222; and the air supply assembly 250 is disposed inside the mounting chamber and opposite the air supply port 223. Such mounting structure reduces space occupied by the air supply assembly 250 and increases a utilization rate of the second storage space 210.

The air supply assembly 250 may include a fan bracket 251 and an air supply fan 252. The fan bracket 251 is disposed at a top wall of the container main body 221 and extends upwards. The air supply fan 252 is mounted on the fan bracket 251, and the top wall of the container main body 221 is provided with a communicating opening below the air supply fan 252. The air supply fan 252 may be turned on or off in a controlled way. After turned on, it can suck air from the air supply port 223 and then supply the air to the second storage space 210 via the communicating opening. The air supply fan 252 may preferably adopt an axial-flow fan with its axis parallel to an extension direction of the communicating opening and the air supply port 223, thus reducing space occupied by the fan. Persons skilled in the art can select other types of fans as required.

To prevent an internal structure of the air supply assembly 250 from being seen by a user from the front portion of the inner-layer door 200 via the communicating opening and improve the appearance aesthetics of the door body 11, the storage container body 220 may further be provided with a grating plate (unshown in the figures), where the grating plate is disposed at the communicating opening, so as to visually shield the air supply assembly 250.

The fan bracket 251 enables a specified space between the air supply fan 252 and the top wall of the container main body 221. The sterilization module 230 may be mounted in the space, that is, the sterilization module 230 is mounted between the air supply fan 252 and the communicating opening, so that sterilization can be performed before an air flow passes through the communicating opening.

The sterilization module 230 may adopt a negative-ion generator, and a similar sterilization effect can be achieved by using technologies such as UV sterilization and filter adhesive membranes. In an embodiment in which a negative-ion generator is used, the sterilization module 230 may include a plurality of negative-ion emitters that are oppositely spaced apart below the air supply fan 252.

The sterilization module 230 may be turned on or off along with the air supply fan 252, for example, the sterilization module 230 is pre-started before the air supply fan 252 is turned on, and turning off of the sterilization module 230 is delayed after the air supply fan 252 is turned off, such that cleanness of the second storage space 210 is guaranteed.

The storage container body 220 may further include at least one dividing element 211. The dividing element 211 is configured to divide the second storage space 210 into a plurality of storage areas. The quantity and structure of the storage areas may be configured according to a storage requirement. In some embodiments, at least one storage area may be configured as a sealed drawer 212, where the sealed drawer 212 may be configured to implement dry-area storage, preservation and the like. One or more sealed drawers 212 may be provided, and a specific quantity thereof may be configured according to the storage requirement.

An internal structure of the second storage space 210 is improved, such that a plurality of storage areas are formed in the second storage space 210, and a sealed drawer 212 may be further formed, greatly expanding use flexibility of the second storage space 210.

Figure 7:
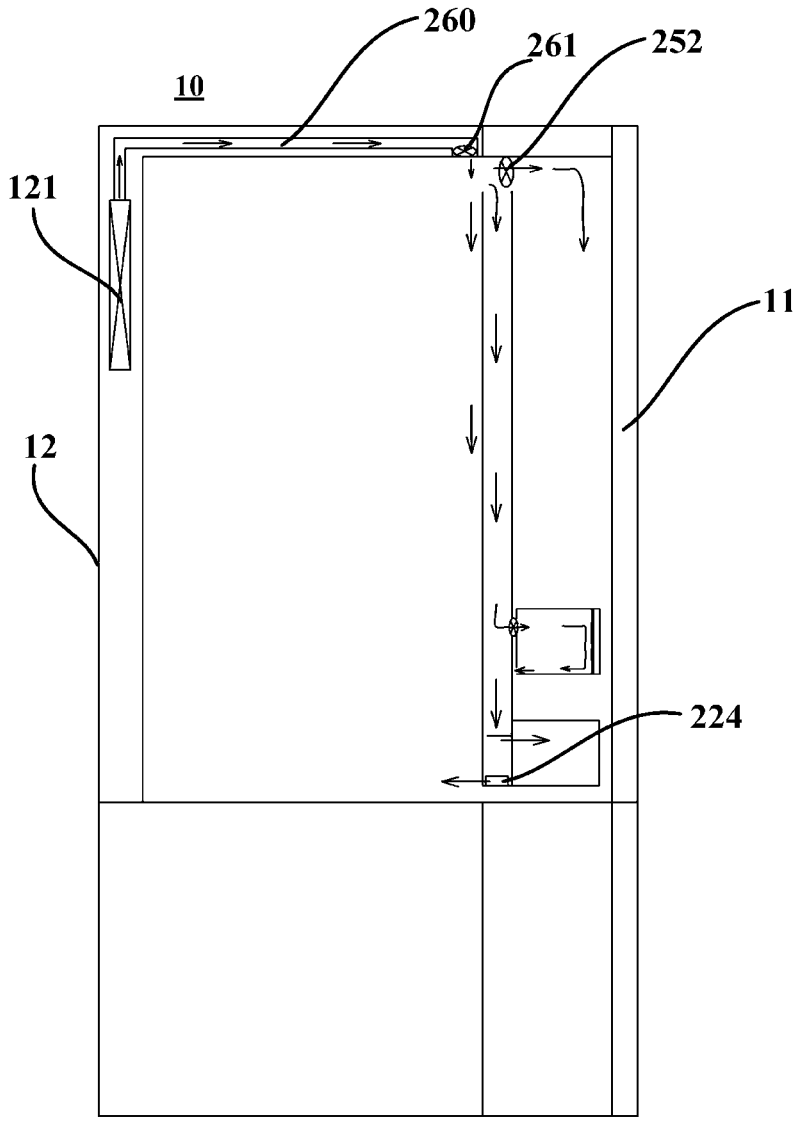
FIG. 7 is a schematic diagram showing that a refrigerating airflow is supplied to a door body of a refrigerator according to an embodiment of the present invention.

FIG. 7 is a schematic diagram showing that a refrigerating airflow is supplied to a door body 11 of a refrigerator 10 according to an embodiment of the present invention. A special air supply duct 260 may be disposed in the refrigerator body 12. The air supply duct 260 extends from a refrigeration chamber 121 of the refrigerator 10 to a front portion of a top wall of the refrigerator body 12, and forms an air duct opening 261 at a position opposite the air supply port 223, such that an airflow supplied by the air supply duct 260 is at least partially discharged into the air supply port 223. A part of airflow discharged from the air duct opening 261 may be discharged into the second storage space 210 to refrigerate the second storage space 210, and the remaining part of airflow discharged from the air duct opening 261 may be partially discharged into the front portion of the first storage space, such that a temperature in the first storage space is equalized. The bottom of the second storage space 210 may further be provided with a door body air return port via which the air in the second storage space 210 can return to the first storage space, thus forming an airflow cycle.

In this embodiment, the second storage space 210 and the first storage space behind can both be configured as a refrigeration storage space. By space division, storage requirements for different objects are met.

According to the refrigerator 10 having a storage space formed on a door body in this embodiment, the internal structure of the second storage space 210 is improved, such that a plurality of storage areas are formed in the second storage space 210, and a sealed drawer 212 may be further formed, greatly expanding use flexibility of the second storage space 210.

In conclusion, it should be learned by those skilled in the art that although various exemplary embodiments of the present invention have been illustrated and described in detail herein, many other variations or modifications consistent with the principles of the present invention may be directly determined or derived from the disclosure of the present invention without departing from the spirit and scope of the present invention. Therefore, the scope of the present invention should be construed and considered as covering all these other variations or modifications.

What is claimed is:

1. A refrigerator having a storage space formed on a door body, comprising:

a refrigerator body, wherein at least a first storage space is defined in the refrigerator body, and the first storage space has a forward opening;

an inner-layer door, pivotally disposed at a front portion of the forward opening and comprising:

a storage container body, wherein the storage container body defines a second storage space, the second storage space is provided with an opening in one side away from the refrigerator body, the storage container body is provided with an air supply port in one side toward the forward opening, and low-temperature air in the first storage space is introduced into the second storage space via the air supply port to implement refrigeration inside the second storage space;

a sterilization module, disposed at the air supply port and configured to sterilize the air passing through the air supply port; and an inner-layer door frame, disposed on the periphery of the storage container body; and an outer-layer door, pivotally disposed on one side of the inner-layer door frame away from the refrigerator body and configured to open and close the opening of the second storage space;

wherein the inner-layer door further comprises an air supply assembly, disposed at the air supply port and configured to promote formation of a refrigerating airflow supplied from the first storage space to the second storage space;

wherein the storage container body comprises:

a container main body, wherein the container main body is configured to constitute the second storage space; and a housing, wherein the housing covers a back of the container main body to serve as a rear wall of the storage container body; the housing and the top of the container main body form a mounting chamber located above a top wall of the container main body;

wherein the air supply port is formed in the top of the housing, and the air supply assembly is disposed inside the mounting chamber and opposite the air supply port;

wherein the air supply assembly comprises:

a fan bracket, disposed at the top wall of the container main body and extending upwards from the top wall of the container main body; and an air supply fan, installed on the fan bracket with a vertical gap between the air supply fan and the top wall of the container main body;

wherein the sterilization module is pre-started before the air supply fan is turned on, and turning off of the sterilization module is delayed after the air supply fan is turned off.

2. The refrigerator having the storage space formed on the door body according to claim 1, wherein one side of the container main body opposite to the refrigerator body protrudes toward the forward opening; and the housing covers a protruding portion of the container main body.

3. The refrigerator having the storage space formed on the door body according to claim 1, wherein the top wall of the container main body is provided with a communicating opening below the air supply fan.

4. The refrigerator having the storage space formed on the door body according to claim 3, wherein the sterilization module is mounted between the air supply fan and the communicating opening.

5. The refrigerator having the storage space formed on the door body according to claim 4, wherein the sterilization module is a negative-ion generator and comprises a plurality of negative-ion emitters that are oppositely spaced apart below the air supply fan.

6. The refrigerator having the storage space formed on the door body according to claim 3, wherein the storage container body further comprises:

a grating plate disposed at the communicating opening.

7. The refrigerator having the storage space formed on the door body according to claim 1, wherein the refrigerator body is further internally provided with:

an air supply duct, which extends from a refrigeration chamber of the refrigerator to a front portion of a top wall of the refrigerator body, and forms an air duct opening at a position opposite the air supply port, such that an airflow supplied by the air supply duct is at least partially discharged into the air supply port, wherein the air duct opening allows a part of the airflow supplied by the air supply duct to be discharged into the second storage space and the remaining part of the airflow to be partially discharged into a front portion of the first storage space.

8. The refrigerator having the storage space formed on the door body according to claim 1, wherein the storage container body further comprises:

at least one dividing element, configured to divide the second storage space into a plurality of storage areas.

9. The refrigerator having the storage space formed on the door body according to claim 8, wherein at least one of the storage areas is configured as a sealed drawer.

10. The refrigerator having the storage space formed on the door body according to claim 1, wherein at least a part of the housing is made of a thermally conductive material.

11. The refrigerator having the storage space formed on the door body according to claim 10, wherein at least a part of the housing is made of metal.

* * * * *